US009545351B2

(12) United States Patent
Sommer et al.

(10) Patent No.: US 9,545,351 B2
(45) Date of Patent: Jan. 17, 2017

(54) MODULAR OPERATING TABLE

(71) Applicants: Thomas Sommer, Ostermundigen (CH); Michael Voegtle, Dogern (DE); Christian Zaugg, Guemligen (CH)

(72) Inventors: Thomas Sommer, Ostermundigen (CH); Michael Voegtle, Dogern (DE); Christian Zaugg, Guemligen (CH)

(73) Assignee: Schaerer Medical Management AG, Muensingen (CH)

( * ) Notice: Subject to any disclaimer, the term of this patent is extended or adjusted under 35 U.S.C. 154(b) by 143 days.

(21) Appl. No.: 14/536,837

(22) Filed: Nov. 10, 2014

(65) Prior Publication Data

US 2015/0135441 A1 May 21, 2015

(30) Foreign Application Priority Data

Nov. 18, 2013 (CH) ..... 1920/13

(51) Int. Cl.
*A61G 13/08* (2006.01)
*A61G 13/00* (2006.01)
(Continued)

(52) U.S. Cl.
CPC ..... *A61G 13/08* (2013.01); *A61G 13/0036* (2013.01); *A61G 13/12* (2013.01); *A61G 13/1205* (2013.01);
(Continued)

(58) Field of Classification Search
CPC A61G 13/08; A61G 13/0036; A61G 13/1285; A61G 13/12; A61G 13/1245; A61G 2013/0081; A61G 2210/50; A61B 6/04; A61B 6/0442; A61B 6/0407; A61B 6/0421
See application file for complete search history.

(56) References Cited

U.S. PATENT DOCUMENTS 2,691,979 A * 10/1954 Watson ..... A61F 5/04 602/39
3,041,119 A * 6/1962 Weickgenannt ..... A61G 13/00 5/614
(Continued)

FOREIGN PATENT DOCUMENTS

WO 2009062545 5/2009

OTHER PUBLICATIONS

European Patent Office, European Search Report, Apr. 21, 2015.
European Patent Office, PCT International Search Report, Apr. 10, 2014.

*Primary Examiner* — Nicholas Polito
*Assistant Examiner* — Eric Kurilla
(74) *Attorney, Agent, or Firm* — Wood Herron & Evans LLP

(57) ABSTRACT

A modular operating table comprises a support (10) and a base part (20) attached to the support (10), the base part (20) providing a first region of a support surface for a patient's body during surgery, the base part (20) comprising side bars (21) extending parallel to a longitudinal axis of the support surface in lateral edge regions of the support surface. A seat element (30) is attached to the base part (20), the seat element (30) providing a second region of the support surface, a width of the second region decreasing in a distal direction, symmetric to a central longitudinal axis of the support surface, the seat element (30) having at least two first connection elements for the distal attachment of functional components, the at least two first connection elements being arranged along main axes of the side bars. A first functional component (40.1, 40.2) comprising a generally triangular plate (42.1, 42.2) provides a third region of the support surface. The first functional component (40.1, 40.2) is attachable to one of the at least two first connection elements of the seat element, the attachment of two of said
(Continued)

first functional components (40.1, 40.2) complementing a generally rectangular support area in a distal region of the seat element (30). The first functional component (40.1, 40.2) has a second connection element for the distal attachment of functional components, the second connection element being arranged along the main axis of the corresponding side bar when the first functional component (40.1, 40.2) is attached to the seat element (30).

17 Claims, 9 Drawing Sheets

(51) Int. Cl.
*A61G 13/12* (2006.01)
*A61G 15/02* (2006.01)

(52) U.S. Cl.
CPC ..... *A61G 13/1245* (2013.01); *A61G 13/1285* (2013.01); *A61G 15/02* (2013.01); *A61G 2013/0081* (2013.01); *A61G 2210/50* (2013.01)

(56) References Cited

U.S. PATENT DOCUMENTS 3,090,381 A * 5/1963 Watson ..... A61G 13/0036 5/624
3,176,975 A * 4/1965 Weickgenannt ..... A61G 13/00 5/614
3,353,820 A * 11/1967 Langren ..... A61G 13/0036 5/612
3,624,396 A * 11/1971 Watson ..... A61F 5/04 378/189
3,766,384 A * 10/1973 Anderson ..... A61B 6/04 378/189
4,223,862 A * 9/1980 Doughty ..... A61B 6/04 211/105.1
4,552,346 A * 11/1985 Schnelle ..... A61G 13/0036 378/209
4,624,245 A * 11/1986 Mullin ..... A61G 13/12 5/621
4,669,106 A * 5/1987 Ammerman ..... A61B 6/0421 128/870
4,872,656 A * 10/1989 Brendgord ..... A61G 13/0036 5/601
5,265,579 A * 11/1993 Ferrari ..... A61B 5/04085 29/825
5,658,315 A * 8/1997 Lamb ..... A61G 13/0036 602/32
5,661,859 A * 9/1997 Schaefer ..... A61G 13/08 5/621
6,202,230 B1 * 3/2001 Borders ..... A61G 13/0009 5/613
6,378,149 B1 * 4/2002 Sanders ..... A61B 6/0442 378/209
8,683,631 B2 * 4/2014 Bellows ..... A61G 13/0036 128/845
8,826,474 B2 * 9/2014 Jackson ..... A61G 7/001 5/610
8,997,749 B2 * 4/2015 Drake ..... A61G 13/0036 128/845
2002/0170115 A1 * 11/2002 Borders ..... A61G 13/101 5/600
2003/0074735 A1 * 4/2003 Zachrisson ..... A61G 13/04 5/607
2003/0167569 A1 * 9/2003 Newkirk ..... A61G 13/12 5/613
2004/0133983 A1 * 7/2004 Newkirk ..... A61G 13/0036 5/624
2006/0117484 A1 * 6/2006 Derenne ..... A61G 13/0009 5/624
2007/0251011 A1 * 11/2007 Matta ..... A61B 19/0248 5/624
2008/0189864 A1 * 8/2008 Marguet ..... A61G 13/12 5/644
2010/0154121 A1 * 6/2010 Swain, Jr. ..... A61G 13/12 5/620
2011/0023893 A1 * 2/2011 Striggow ..... A61G 13/12 128/882
2012/0271350 A1 * 10/2012 Palmer ..... A61G 13/009 606/242
2013/0006243 A1 * 1/2013 Friedrich ..... A61G 13/0036 606/57
2013/0081635 A1 * 4/2013 Drake ..... A61G 13/0036 128/845
2013/0247301 A1 9/2013 Daley et al.
2014/0068863 A1 * 3/2014 Clark ..... A61G 13/0036 5/621
2014/0068864 A1 * 3/2014 Clark ..... A61G 13/101 5/621
2014/0215718 A1 * 8/2014 Wootton ..... A61G 13/0036 5/621
2015/0290064 A1 * 10/2015 Kreuzer ..... A61G 13/02 128/845
2016/0000627 A1 * 1/2016 Jackson ..... A61G 13/02 5/608
2016/0000628 A1 * 1/2016 Koch ..... A61G 13/04 5/611
2016/0095773 A1 * 4/2016 Ruch ..... A61G 7/018 5/616

* cited by examiner

MODULAR OPERATING TABLE

TECHNICAL FIELD

The invention relates to a modular operating table comprising a support and a base part attached to the support, the base part providing a first region of a support surface for a patient's body during surgery, the base part comprising side bars extending parallel to a longitudinal axis of the support surface in lateral edge regions of the support surface. The modular operating table further comprises a seat element attached to the base part, the seat element providing a second region of the support surface, a width of the second region decreasing in a distal direction, symmetric to a central longitudinal axis of the support surface, the seat element having at least two first connection elements for the distal attachment of functional components, the at least two first connection elements being arranged along main axes of the side bars. A first functional component comprises a generally triangular plate providing a third region of the support surface, the first functional component being attachable to one of the at least two first connection elements of the seat element, the attachment of two of said first functional components complementing a generally rectangular support area in a distal region of the seat element.

BACKGROUND ART

Such modular operating tables that allow for different configurations, depending on the surgical operation to be performed, are known in the prior art.

As an example, WO 2009/062545 A1 (Schaerer Mayfield) discloses an operating table comprising a base plate, a central supporting means, a lying down area, and a modular device for positioning and immobilisation of a patient's body for surgical operations. The modular device comprises a first supporting means for supporting the patient's pelvis and at least one second supporting means with a foot tether-connecting means for immobilisation and positioning of a patient's leg, whereby the at least one second supporting means is pivotable in the horizontal and/or in the vertical plane with respect to the first supporting means. This design allows for easy positioning and immobilization of the patient's legs for orthopedic surgical operations. The positioning can be performed not only prior to the operation, but also during the operation in an easy way, also by non-sterile persons. The modular construction therefore allows for performing a broad spectrum of different kinds of orthopedic operations, including minimally invasive surgical operations on the hip and/or pelvis of a patient.

The operating table proposed in WO 2009/062545 A1 allows for the attachment of (temporary) supports that are used in the context of orthopedic surgery. However, in trauma surgery it is often not known as initio what kind of surgical interventions will be necessary. Accordingly, based on a first inspection of the patient, experience and intuition the responsible surgeon will choose either an orthopedic (trauma) operating table or a universal operating table. If it turns out later that the other type of table should be used the patient needs to be repositioned onto the other table which takes valuable time and represents a burden on the patient. Despite the modularity of the (modular orthopedic) operating table shown in WO 2009/062545 A1 repositioning will be necessary if a universal operating table is favorable.

SUMMARY OF THE INVENTION

It is the object of the invention to create a modular operating table pertaining to the technical field initially mentioned, that has favorable characteristics as an orthopedic operating table as well as a universal operating table.

The solution of the invention is specified by the features of claim 1. According to the invention the first functional component has a second connection element for the distal attachment of functional components, the second connection element being arranged along the main axis of the corresponding side bar when the first functional component is attached to the seat element.

The side bars are load bearing elements carrying the elements providing the support surface for the patient's body. Preferably, the side bars are arranged below the support surface. According to the invention, the second connection elements are arranged along the main axis of the side bars of the operating table (i.e. substantially in the direct extension of the side bars). This means that the load bearing part of the second connection element lies essentially in the main axis of the corresponding side bar.

This specific layout provides for an easy and stable attachment of function components to the second connection element. The inventive arrangement of the connection elements allows for assembling a universal-type operating table with a stable frame, and therefore high rigidity. Furthermore, even if metal side bars and connection elements are used, an x-ray window between the side bars is not obstructed by elements of the structural frame. Nevertheless, by attaching different functional elements (and removing one or both of the first functional components, if required), the operating table may be used as a full-fledged orthopedic operating table. Accordingly, in traumatology, a repositioning of the patient to another table will not be required, but the configuration of the table may be easily and quickly adapted.

In the context of the inventive modular table, the seat element serves different purposes. In combination with the first functional component it constitutes an element of a universal (general purpose) operating table. Without removing or replacing the seat element, by just removing one or both first functional components, the table may be converted to an operating table suitable for orthopedic or traumatology applications. The form of the remaining seat element is adapted to these applications.

It is to be noted that the seat element may be permanently affixed to the base part, or that these two components may even be a unitary element of the operating table. In contrast, the seat element may be removable from the base part of the operating table. This allows for replacing the seat element with a different component for special applications.

The second region of the support surface, provided by the seat element, may have a generally triangular form. However, it is also possible that the width of the second region decreases only in an axial region of the seat element. In a preferred embodiment, the form of the second region is composed of a proximal rectangular region and a distal trapezoid-shaped region. Here and in the following, "proximal" relates to a position along the longitudinal axis (axial) of the support surface closer to the base part ("head direction" in most applications), whereas "distal" relates to a position further away from the base part ("foot direction" in most applications).

In particular, the side bars of the base part, corresponding support bars of the seat element and corresponding support bars of the first functional components have essentially the same cross-section at mutual contact surfaces and the first and second connection elements are positioned within this cross-section. Preferably, the support bars of the seat element extend only along a part of the axial length of the seat element and are extended by the support bars of the first functional components if these components are attached.

Preferably, the seat element is x-ray transparent, i.e. a substantial part of the second region of the support surface is x-ray transparent. In particular, a plate providing the second region of the support surface is made from carbon fiber reinforced polymers. In combination with not having a central beam obstructing the view, this allows for comprehensive x-ray imaging in the area of the seat element. By slightly shifting the patient to one side, essentially the entire part of the body supported by the seat element (e.g. the pelvis), may be captured by x-ray imaging.

Preferably, the generally triangular plate of the first functional component is x-ray transparent as well. It may as well be manufactured from carbon fiber reinforced polymers.

Preferably, the seat element further has at least one third connection element comprising an articulation mechanism for the attachment of functional components. Such functional components include in particular traction bars for attaching traction units.

Add-on hinges may be employed for creating a further articulation axis, e.g. in order to be able to fold away the traction bar when not in use.

Advantageously, the at least two first connection elements of the seat element comprise a retainer for receiving a connection peg of a functional component attached to the seat element, and a locking element for selectively locking the connection peg received in the retainer. This type of connection allows for the transfer of strong forces and ensures high stability.

Preferably, the retainer is provided in a housing, and the articulation mechanism of the third connection element is attached to the housing of the retainer. Accordingly, a compact and stable construction is obtained and the area that is not x-ray transparent is minimized.

In a preferred embodiment, the locking element comprises an undercut projection, and an attachment mechanism of the first functional component cooperating with one of the at least two first connection elements comprises a spring-loaded latch cooperating with the undercut projection. The first functional component further comprises an operating element for releasing the latch. Using such a locking element allows for easily assembling the seat element and the functional component by essentially introducing the connection peg of the functional element into the retainer of the seat element, the latch catching the undercut projection as soon as an end position is reached. No tightening of screws or similar elements is needed. Furthermore, it is advantageous that the operating element is arranged at the component to be attached or removed as this allows for easy one-handed operation. The functional element may thus be easily released by operating the operating element.

Preferably, the at least two first connection elements of the seat element provide an additional point of support for the functional components in order to obtain a torque proof connection. Using a spaced further point of support allows for supporting strong torques.

Alternatively, the first connection elements and the cooperating elements of the functional components are designed in such a way that a torque proof connection is obtained without having a further (spaced) point of support, e.g. by using a profiled peg interacting with a correspondingly profiled retainer.

In a further preferred embodiment, the seat element comprises at least two holes for connecting extension elements, in particular for connecting a perineal post, the two holes being arranged along a line perpendicular to the longitudinal axis of the support surface. The axes of the holes will be substantially vertical, i.e. perpendicular to the support surface and parallel to the perineal posts to be connected to the holes.

As discussed below, this arrangement of holes creates a number of possibilities for connecting the perineal post or other extensions such as e.g. a knee support, allowing the surgeon to choose the best position of the extension element for the surgical intervention at hand.

Preferably, the holes penetrate a base plate of the seat element, and the seat element comprises a cover for covering the holes, the cover constituting a section of the second region of the support surface when attached to the base plate of the seat element. Similar to the rest of the second region, the cover is preferably provided with a pad. Accordingly, if no perineal post is needed or if the post is connected to the lower side of the base plate, the holes will be covered by the cover. If the cover is removed, the perineal post may be connected to the upper side of the base plate, in the simplest case a connection piece of the perineal post is introduced into one of the holes and the position of the post will correspond with the position of the respective hole.

Furthermore, an offset element comprising at least two pins for cooperating with the at least two holes of the seat element and at least one connection element for the perineal post may be employed. This allows for having further positions of the perineal post, not corresponding with the position of the two holes. Furthermore, the offset element may be connected to the lower side of the base plate, and the cover for covering the holes may be left in its position on the upper side of the base plate. Even more preferred, the offset elements are designed in such a way that they may be connected to the upper side of the base plate by removing the cover, inserting the pins into the holes of the seat element and attaching the cover again, covering inter alia a part of the offset element.

Different offset element configurations are possible, such as a lateral offset holder having the two pins and the connection element arranged essentially along a straight line, creating a perineal post position laterally of the seat element. A further variant is a central offset holder, having the two pins and the connection element arranged at the corners of an isosceles triangle, creating a perineal post position on the longitudinal axis of the support surface, distal with respect to the seat element.

Using these two offset holders and the holes themselves, at least five different perineal post positions are provided.

Preferably, the modular operating table includes a perineal post holder comprising a base that is connectible with the at least two holes of the seat element and at least one adjustable arm providing a mount for a perineal post, the adjustable arm being attachable to the base in at least two angular positions. In particular, the arm is adjustable in a horizontal plane and a first angular position is essentially parallel to the longitudinal extension of the operating table and the second angular position is essentially perpendicular to that longitudinal extension. In particular, the arms comprise a means for attaching the arm to the base at a first end thereof and a means for attaching the perineal post at a second end thereof, opposite the first end.

The adjustable perineal post holder allows for storing the arm in a position where it does not impede the treatment of the patient if no perineal post is needed as well as for easy and quick relocation to a position in which the perineal post may be attached and where it is held at the right position for respective surgery.

Preferably, the modular operating table includes a head support adapter comprising a first portion for attaching the head support adapter to the seat element using the at least two holes and a second portion for attaching a head support. This allows for using the operating table in an inverse position, in which the seat element provides support for the back of the patient, in order to do shoulder surgery. The form of the seat element with its decreasing width ensures that the shoulder is easily accessible by the surgeon. Accordingly, the scope of application of the operating table is greatly enhanced.

Preferably, the first portion of the head support adapter is connected to the second portion of the head support adapter by means of a hinge and the first portion and the second portion sandwich a base plate of the seat element in a mounted state of the head support adapter. In particular it is the region of the base plate comprising the holes that is sandwiched.

This allows for a quick, easy and stable attachment of the head support adapter.

Preferably, the modular operating table includes a knee support adapter comprising a first portion for attaching the knee support adapter to the seat element using the at least two holes and a second portion for attaching a knee support in a region of a central vertical plane of the modular operating table. The second portion may be rail-like such that the knee support may be attached by available elements for mounting attachments such as knee supports to side rails of an operating table.

Having an opportunity to attach the knee support in a central region of the operating table enhances the surgeon's possibilities. In particular, a knee support that is attached in a central region does not impede actions on the patients that are effected from the side of the operating table.

As described above, the two holes provided in the seat element allow for the connection of a variety of extension elements such as perineal posts, head supports or knee supports. They therefore greatly enhance the scope of application of the operating table. In principle, the interface provided by the two holes may be used in the context of operating tables that have an arrangement of the connection elements for connecting functional components that is different from that of the invention described above. Accordingly, a modular operating table with advantageous characteristics may comprise just the following elements:

a) a support and
b) a base part attached to the support, the base pan providing a first region of a support surface for a patient's body during surgery;
c) a seat element attached to the base part, the seat element providing a second region of the support surface, a width of the second region decreasing in a distal direction, symmetric to a central longitudinal axis of the support surface; where
d) the seat element comprises at least two holes for connecting extension elements, the two holes being arranged along a line perpendicular to the longitudinal axis of the support surface.

In particular, the two holes are arranged in a region with reduced width, opposite to the region where the seat element adjoins the base part. The modular operating table may comprise further components as described above as needed.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

Figure 1A:
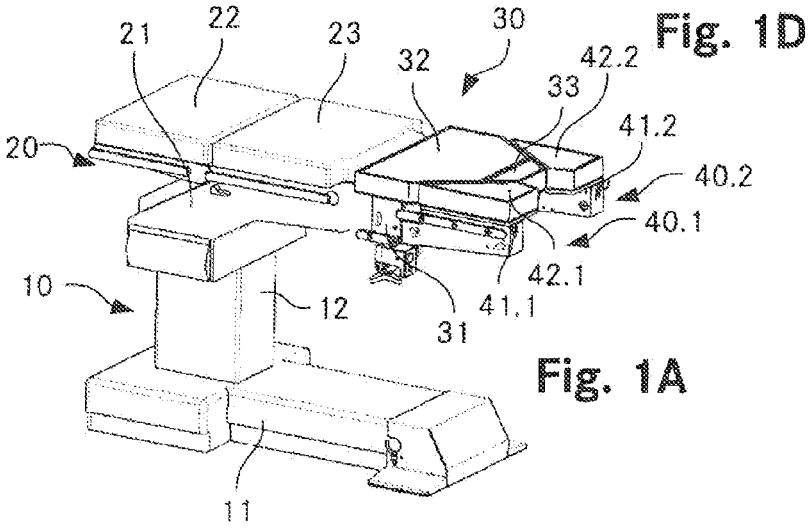
FIG. 1A-C Three configurations of a modular operating table according to the invention.
Figure 1D:
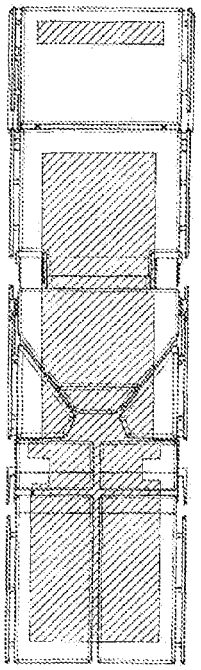
FIG. 1D a schematic representation of the x-ray window of the operating table in the general configuration.

FIG. 1 shows three configurations of a modular operating table according to the invention. FIG. 1A shows the basic group of components that is used for orthopedic applications as well as in the context of general surgery. The operating table comprises an L-shaped support 10, including a pedestal 11 and a vertical column 12. The column 12 carries a base part 20 including a main frame 21 including two lateral bars extending in the longitudinal direction of a support surface, the bars carrying two generally rectangular support plates 22, 23. As known, the base part 20 and the main frame 21 are constructed in such a way that an angle included by the two support plates 22, 23 is variable, in particular to obtain a seat-like configuration of the operating table, as need for example in the field of shoulder surgery.

Attached to the base part 20, distal with respect to the two support plates 22, 23, is a seat element 30. The seat element 30 is described in more detail in connection with FIG. 2 below. Essentially, the seat element 30 comprises a basis 31 and a support plate 32 attached to the basis, the support surface presented by the support plate 32 being complanar with the support surfaces of the support plates 22, 23 when the operating table is in the flat position as shown in FIGS. 1A-D. The shape of the support surface of the seat element 30 is composed of a proximal rectangular region and a distal trapezoid region, where an angle between the lateral edges of the trapezoid region and the longitudinal axis of the support surface of the operating table is about 30°. The most distal part of the surface is constituted by a cover 33, the surface of which lying in the same plane as the main region of the support surface of the seat element 30.

Attached to the seat element 30 are two complementing table elements 40.1, 40.2.

These two elements have essentially the same construction but are the mirror image of each other, i.e. there is a right complementing table element 40.1 and a left complementing table element 40.2. The elements are described in more detail in connection with FIG. 3 below. Essentially, the complementing table elements 40.1, 40.2 comprise a basis 41.1, 41.2 and a support plate 42.1, 42.2 attached to the basis, the support surfaces presented by the support plates 42.1, 42.2 being complanar with the support surface of the seat element 30. Together, the seat element 30 and the complementing table elements 40.1, 40.2 form an essentially rectangular support surface, whereas at the distal end of the surface, an essentially trapezoidal cut-out is formed that may be used in gynaecology applications.

Figure 1B:
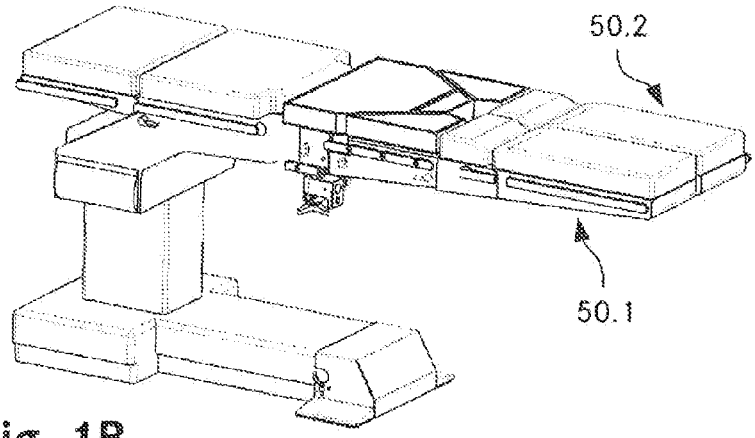

FIG. 1B shows the configuration for general surgery (i.e. a universal operating table). Leg plates 50.1, 50.2 known as such are connected to the complementing table elements 40.1, 40.2. Thus, an essentially rectangular support surface is formed supporting the entire body of a reclining patient.

Figure 1C:
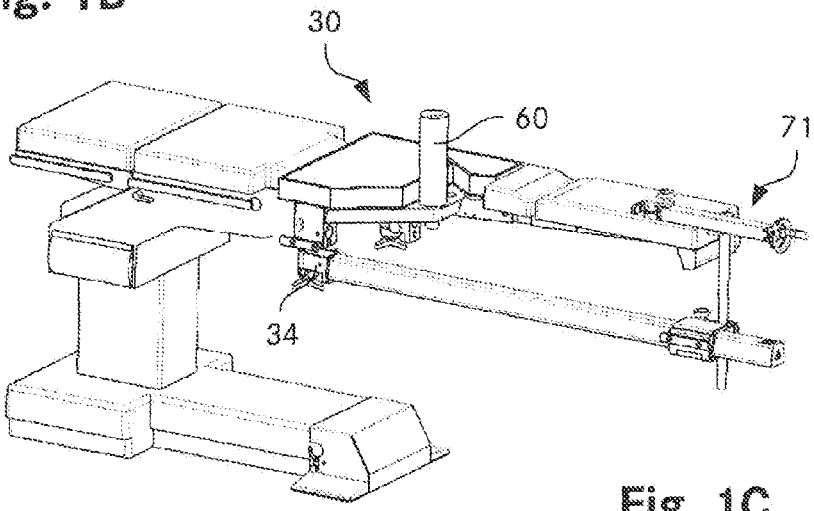

FIG. 1C shows the configuration for ortho-trauma applications. The right complementing table element 40.1 and the cover 33 of the seat element 30 have been removed. A perineal post 60 is attached to the seat element 30 and a traction bar 70 made from carbon (or another radiotranslucent material) is attached to an articulation mechanism 34 of the seat element 30. The traction bar 70 carries a traction unit 71 known as such.

Further configurations are possible. As an example, the table may be used for tibia nailing procedures, using essentially the configuration as shown in FIG. 1C, but attaching a knee rest instead of the perineal post. Furthermore, the table may be used for shoulder surgery, where the seat plate is used as a back plate.

It is to be noted that in all configurations the operating table provides an extended x-ray window, basically extending over the whole region enclosed by the main frame 21 and the marginal frame elements of the additional components attached to the basic group of components of the operating table. As an example, FIG. ID shows the x-ray window (hatched areas) of the table in the general configuration as shown in FIG. 1B.

If the second complementing table element of the configuration of FIG. 1C for ortho-trauma applications is removed and replaced by a further radiotranslucent traction bar, the entire region distal from the attachment of the seat element 30 to the base part 20 is made from translucent material. Accordingly, this region is 360° tradiotranslucent, substantially facilitating radiological examinations of the hip and legs of the patient.

Figure 2A:
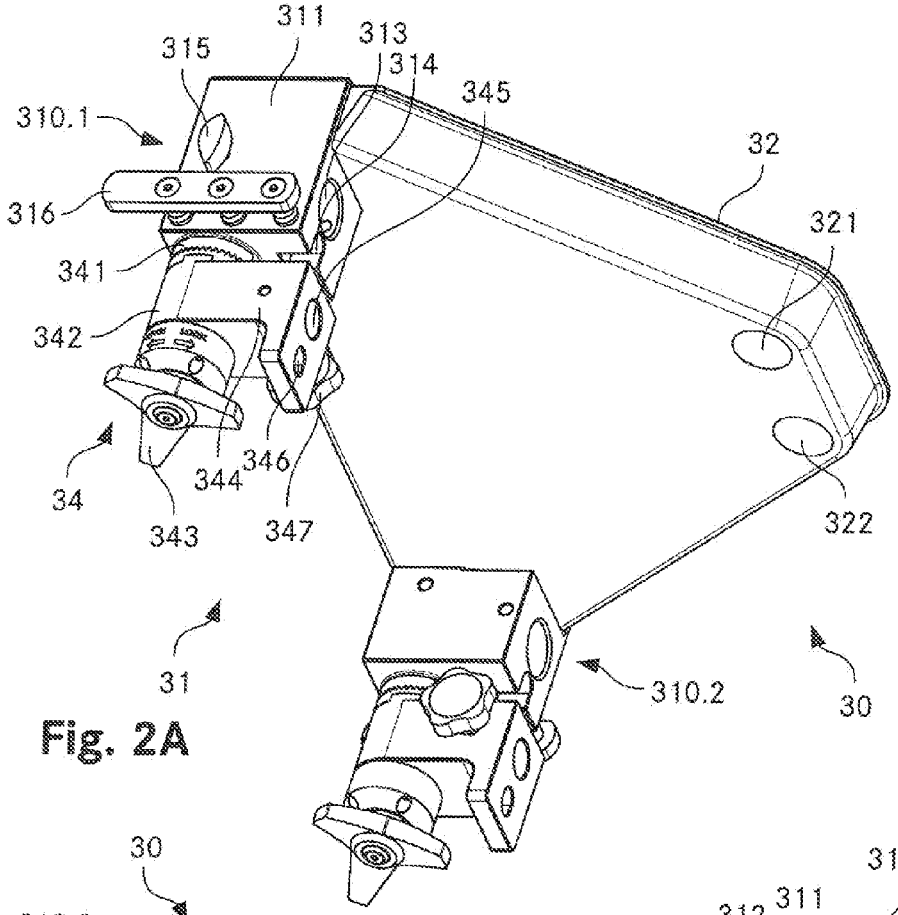
FIG. 2A, B oblique views of the seat element of the operating table.
Figure 2B:
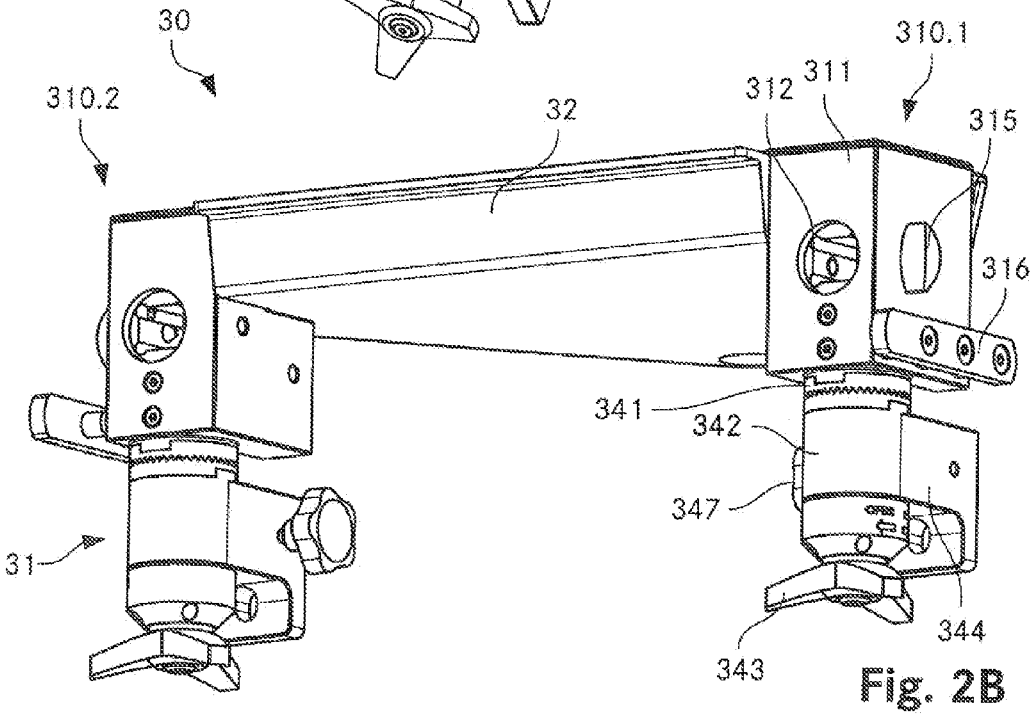

FIGS. 2A, B show two different oblique views of the seat element of the operating table. The seat element 30 comprises a basis 31 constituted by lateral groups 310.1, 310.2. Both lateral groups 310.1, 310.2 are of the same construction, they are essentially the mirror image of each other. Accordingly, in the following the description will refer to just one of the two groups, namely the right lateral group 310.1.

The lateral group 310.1 includes a bar element 311 which is constituted by an essentially cuboid shaped housing, the cross section of which along a vertical plane perpendicular to the longitudinal axis of the support surface corresponding to that of the lateral bars of the base part of the operating table. As an example, the cross-section of the housing is rectangular with a height and width of 25 and 10 mm, respectively. On a proximal surface, the bar element 311 comprises a first opening 312, on a distal surface the bar element 311 comprises a second opening 313 and a third opening 314. The first opening 312 and the second opening 313 essentially share a common axis, whereas the third opening 314 is arranged below the first and second opening. Behind the first opening 312 extends a retainer having an essentially square cross-section for accommodating a peg having essentially the same profile. The connection between the retainer and the peg accommodated therein may be fixed by tightening a butterfly screw 315, the tip of which being rounded and cooperating with a corresponding inward projection on the outside of the profiled peg.

Behind the second opening 313 extends a retainer having an essentially circular cross-section for accommodating a peg having essentially the same profile. The third opening 314 accommodates a further peg. The connection between the seat element 30 and a functional element arranged distally of the seat element 30 is described in more detail in connection with FIG. 4 below.

By means of a plurality of screws, a side rail 316 is attached to the bar element 311. The side rail 316 is a standard component of operating tables, having standardized dimensions. The side rail 316 of the seat element 30 is parallel to the corresponding side rails of the elements of the basic group of components of the operating table but arranged in a lower horizontal plane.

Further attached to the bar element 311 is an articulation mechanism 34. The articulation mechanism 34 comprises a base part 341, which is fixedly attached to the bottom surface of the housing of the bar element 311. An axis is attached to the base part 341, a rotatable part 342 of the articulation mechanism 34 is supported rotatably on that axis, furthermore, the rotatable part 342 is movable along a certain axial distance along the axis and therefore with respect to the base part 341 of the articulation mechanism 34. The interacting surfaces of the base part 341 and of the rotatable part 342 comprise radial serrations such that a mutual rotational position of the two parts is fixed as long as the interacting surfaces closely contact each other. Using a hand wheel 343, the distance between the base part 341 and the rotatable part 342 may be increased such that the serrations get out of contact and the rotatable part 342 may be freely rotated with respect to the base part 341. A functional element may be connected to the rotatable part 342 by inserting corresponding pegs into two openings 345, 346 provided in a connecting section 344 of the rotatable part 342. The connection between the functional element and the articulation mechanism 34 may be fixed by tightening a further butterfly screw 347, the rounded tip of which interacting with a corresponding inward projection on the outside of the peg introduced into the opening 345. The peg introduced into the further opening 346 ensures the locking against rotation of the functional element with respect to the articulation mechanism 34.

The seat element 30 further comprises a support plate 32 fixed to both lateral groups 310.1, 310.2 and extending into a distal direction. The support plate 32 is made from carbon fiber reinforced polymers. It is provided with two holes 321, 322, the axes of which extending in a direction perpendicular to the main surface of the support plate 32. On the upper side of the support plate, the two holes 321, 322 are covered by the cover 33 (see FIG. 1A).

Figure 3A:
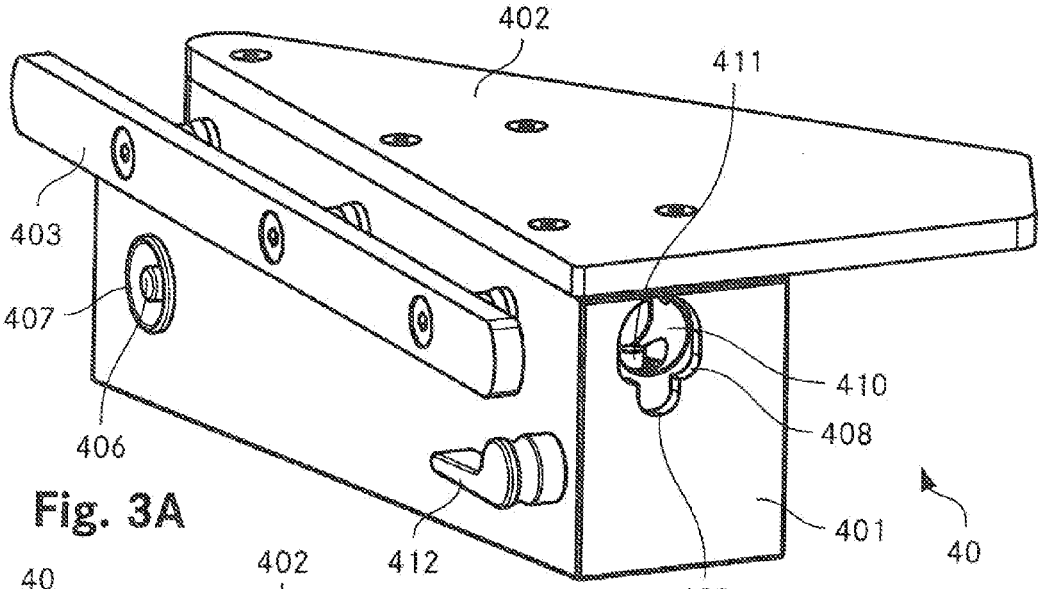
FIG. 3A, B an oblique view and a lateral view of one of the complementing table elements of the operating table.
Figure 3B:
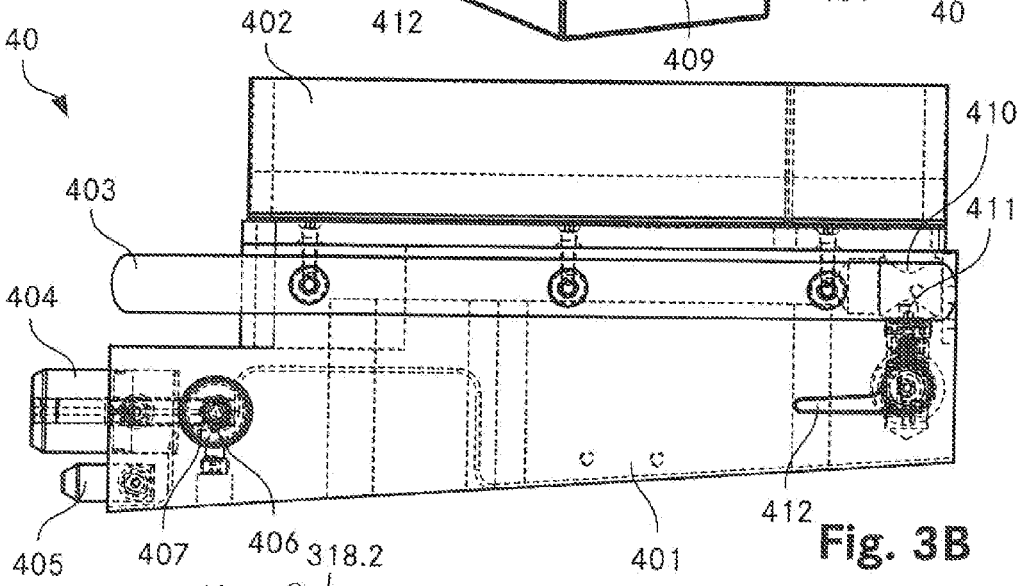

FIGS. 3A, B are an oblique view and a lateral view of one of the complementing table elements 40 of the operating table. The complementing table element 40 comprises a bar section 401 and a table section 402 attached to the bar section 401. The table section 402 has a generally triangular shape, whereas the proximal angle is about 30°, the distal outer angle is 90° and the distal inner angle is about 60°. In the region of the distal inner angle the respective corner is chamfered, the proximal corner is rounded. The table section 402 is attached to a housing of the bar section 401 by means of five screws.

The geometry of the housing of the bar section 401 corresponds to the geometry of the lateral bars of the main frame 21 of the base part 20 (cf. FIG. 1A). As an example, the cross-section of the housing is rectangular with a height and width of 10 and 25 mm, respectively. Attached to the housing by means of a plurality of screws is a side rail 403. The side rail 403 is a standard component of operating tables with standardized dimensions. The side rail 403 of the complementing table element 40 runs in the extension of the corresponding side rails of the elements of the basic group of components of the operating table.

In a proximal region, a lower section of the housing of the bar section 401 projects over the proximal edge of the table section 402. In this projecting section, the complementing table element 40 comprises two pegs, main peg 404 as well as an auxiliary peg 405 arranged vertically below the main peg 404. The cross-section of the pegs is circular, the diameter of the auxiliary peg 405 is substantially smaller than that of the main peg 404 (the ratio is about 1:3). In the region of their free ends, the main peg 404 and the auxiliary peg 405 have the geometry of a truncated cone. In the region of the pegs, a push button 406 is arranged centrally in a substantially hemispheric indent 407 of the housing. The main peg 404 and the auxiliary peg 405 as well as the push button 406 are used for connecting the complementing table element 40 to the seat element 30. The corresponding connection is described in more detail in connection with FIG. 4 below.

In a distal region, the housing is provided with a retainer opening 408 for accommodating a peg of a further element to be attached to the complementing table element 40. In the corresponding wall of the housing, the opening 409 has essentially the form of a circle provided with an additional substantially semi-circular convexity in a lower region of the opening. Behind the wall of the housing, a guide element 410 is arranged, having a circular inner cross section and being provided with a locking pin 411 that may be operated by means of an operating lever 412 on the lateral outer wall of the housing of the bar element 401. The operating lever 412 features an eccentric bearing and acts onto the locking pin 411 when operated. First, the free end of the locking pin 411 enters into an annular indentation of a peg of the further element to be attached. Secondly, the locking pin 411 is pressed against the peg and thereby pushes the peg against the opposite wall of the guide element 410 in order to remove play. It is to be noted that the construction of the distal connector is known from the prior art and that the use of such a connector allows for the attachment of available auxiliary components and table elements.

Figure 4:
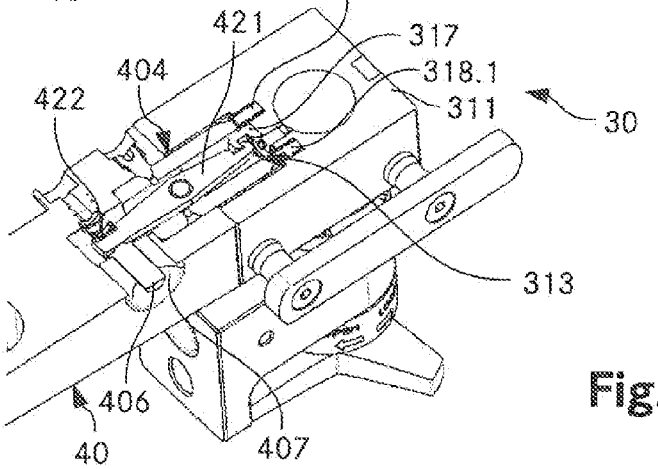
FIG. 4 an oblique view of the connection between the seat element and the complementing table element.

FIG. 4 is an oblique view of the connection between the seat element 30 and the complementing table element 40. The main peg 404 of the complementing table element 40 has the geometry of a hollow cylinder. A pivoted lever 421 is centrally supported on a vertical pivot axis. The inner end of the pivoted lever 421 contacts the inner end of the push button 406. A spring 422 is arranged opposite to the push button 406 and pushes the pivoted lever 421 into an engaging position and the push button 406 into a protruding position. The outer end of the pivoted lever 421 is provided with a hook-like geometry and ends in the end region of the main peg 404.

In the connected position shown in FIG. 4, the second opening 313 in the bar element 311 and the retainer arranged behind the second opening 313 accommodate the main peg 404. The hook-like geometry of the pivoted lever 421 interacts with a hook element 317 fixedly attached to the bar element 311. Two spring-loaded cylinders 318.1, 318.2 are arranged parallel to the hook element 317. The auxiliary peg 405 interacts with the third opening of the bar element 311 (see FIG. 2A).

In order to release the complementing table element 40 from the seat element 30, the push button 406 is operated against the force of the spring 422. Accordingly, the pivoted lever 421 is displaced such that the hook-like geometry of the outer end of the pivoted lever 421 disengages from the hook element 317 of the bar element 311. Now, the complementing table element 40 may be pulled in an axial direction and fully released from the seat element 30. Accidental operation of the push button 406 is prohibited by the arrangement of the push button 406 inside the hemispheric indent 407.

In order to attach the complementing table element 40 to the seat element 30, it is sufficient to push the two pegs of the complementing table element 40 into the respective openings of the bar element 311 of the seat element 30 until the hook-like outer end of the pivoted lever 421 engages the hook element 317 of the bar element 311. The spring-loaded cylinders 318.1, 318.2 of the bar element 311 interact with the main peg 404 of the complementing table element 40 such that the connection is pre-stressed. Operation of the push button 406 is not required as the geometry of the hook-like end of the pivoted lever 421 is chosen in such a way that the forces acting on this end when it contacts the hook element 317 during insertion of the pegs lead to a pivoting movement of the lever against the force of the spring 422, allowing engagement of the hook-like elements.

The FIGS. 5A-D are oblique views of two variants of connecting a perineal post with the operating table as well as of the offset holders used. The Figure SA shows a laterally offset arrangement of perineal post 60. A lateral offset holder 61 shown in Figure SB comprises two connection pegs 611, 612 and a post support 613 all arranged along a straight line and all attached to a connecting bar 614. The connection pegs 611, 612 interact with the two holes 321, 322 in the support plate 32 of the seat element 30 (see FIG. 2A). After the offset holder 61 has been attached to the seat element 30, the cover is reattached, covering inter alia the upper end of the connection pegs 611, 612 and a region of the connecting bar 614. The perineal post 60 is connected to the post support 613. The perineal post is made from a radiolucent material and features an interchangeable pad. Using the lateral offset holder 61 two laterally offset positions of the perineal post 60, on the right as well as on the left side, in line with the two holes 321, 322 of the seat element 30 are obtained.

Figure 5A:
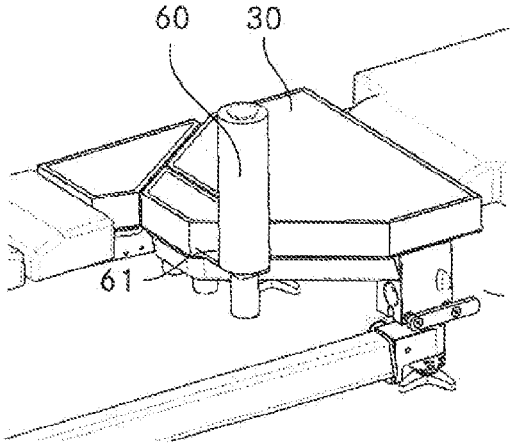
FIG. 5A-D oblique views of two variants of connecting a perineal post with the operating table as well as of the offset holders used.
Figure 5B:
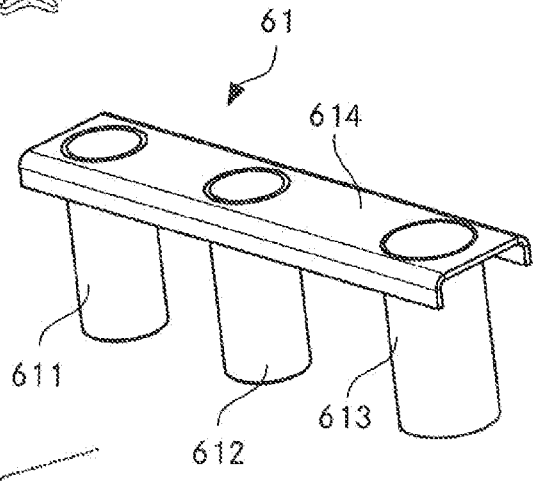
Figure 5C:
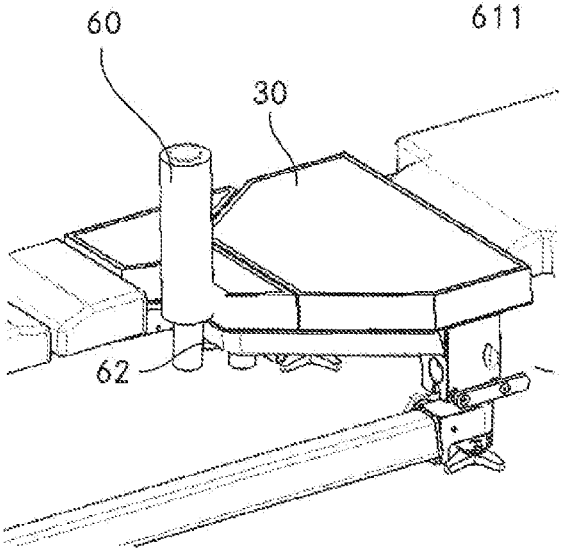
Figure 5D:
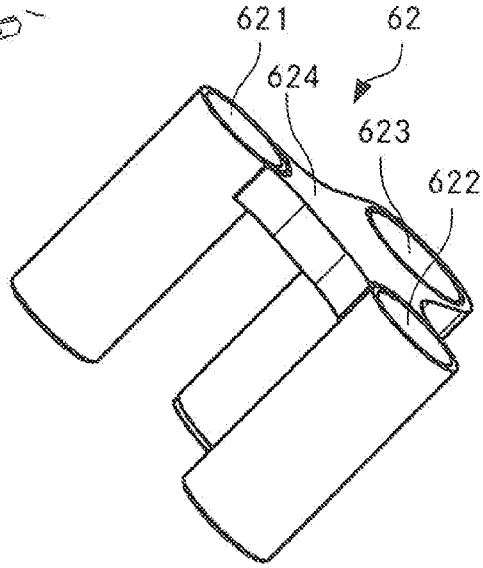

The FIG. 5C shows an axially offset arrangement of perineal post 60. An axial offset holder 62 shown in FIG. 5D comprises two connection pegs 621, 622 and a post support 623 arranged in the corners of an isosceles triangle and all attached to a connecting base 624 having the respective geometry. The connection pegs 621, 622 interact with the two holes 321, 322 in the support plate 32 of the seat element 30 (see FIG. 2A). After the offset holder 62 has been attached to the seat element 30, the cover is reattached, covering inter alia the upper end of the connection pegs 621, 622 and a region of the connecting base 624. The perineal post 60 is connected to the post support 623. Using the axial offset holder 61 an axially offset position of the perineal post 60, distal with respect to the two holes 321, 322 of the seat element 30 is obtained.

For hip arthroscopy, perineal rods having a larger diameter may be attached in the same way as the perineal rod 60 shown in FIGS. 5A, 5C.

Figure 6A:
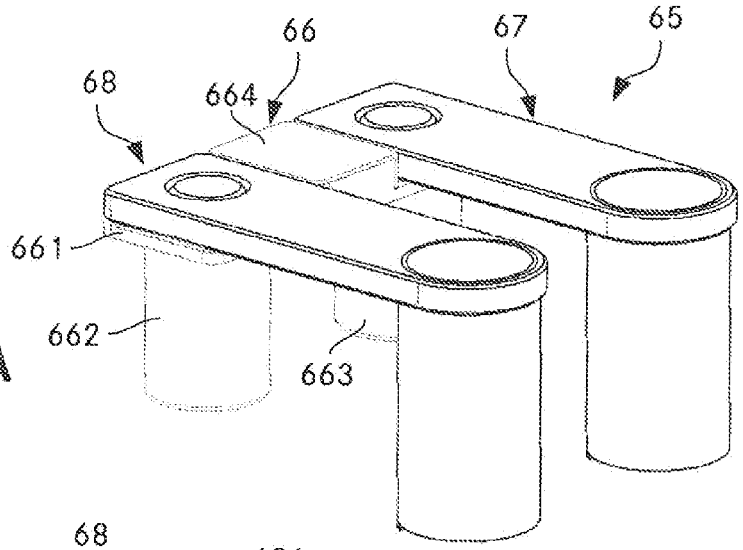
FIG. 6A-C oblique views of a holding mechanism for a perineal post in different operating positions.
Figure 6B:
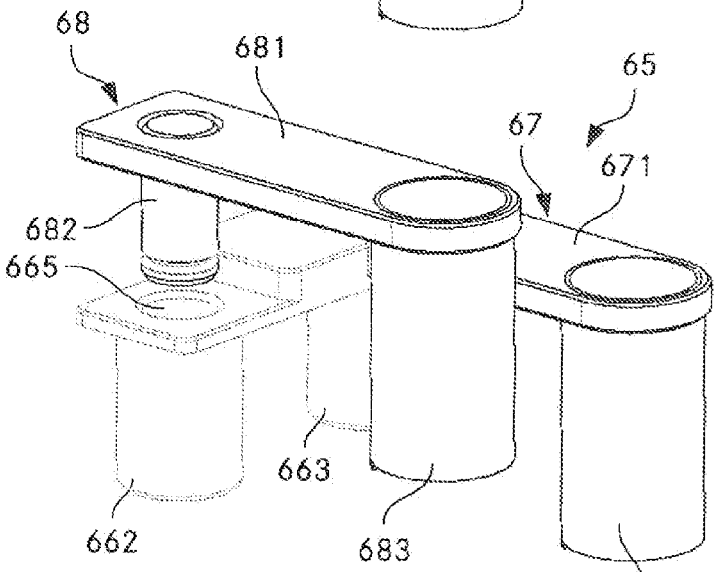
Figure 6C:
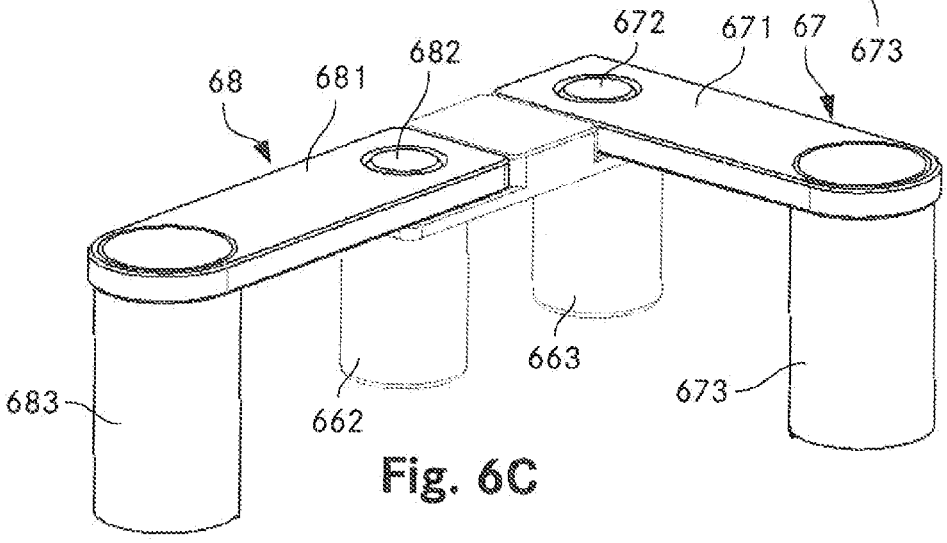

The FIGS. 6A-C are oblique views of a holding mechanism for a perineal post in different operating positions. The FIGS. 7A, B show oblique views of the holding mechanism attached to the operating table in different operating positions.

The holding mechanism 65 includes a base part 66 and two adjustable arms 67, 68 that cooperate with the base part 66. The base part 66 features a generally planar plate 661, on the underside of which two hollow connection pegs 662, 663 are affixed. The connection pegs 662, 663 cooperate with the two holes 321, 322 in the support plate 32 of the seat element 30 in order to attach the base part 66 to the seat element 30. In a central region, the plate 661 features a protruding part 664, the lateral edges of which running across the main extension of the plate 661. On both sides of the protruding part 664, connection holes 665 leading into the inside of the hollow connection pegs 662, 663 are arranged.

The two adjustable arms 67, 68 each comprise a generally planar plate 671, 681. Near one end of each of the plates 671, 681, a connection peg 672, 682 is attached to the underside of the respective plate 671, 681. Near the other end of each of the plates 671, 681, a post support 673, 683 is attached. A perineal post 60 may be connected to the post support 613. The adjustable arms 67, 68 may be attached to the base part 66 in three angular positions (two of which are effectively used), the main extension of the adjustable arm 67, 68 being collinear or perpendicular to the base part 66 (cf. FIG. 6C, where one of the arms 67 is in a perpendicular position whereas the other of the arms 68 is in a collinear position). The position is fixed due to the cooperation of the edge of the arm 67, 68 in the region of the connection peg 672, 682 with the edge of the protruding part 664 of the base part 66. An arm 67, 68 may be moved from one of the positions to the other by slightly lifting the arm 67, 68 until the plate 671, 681 of the arm 67, 68 is positioned above the protruding part 664 of the base part 66, subsequently adjusting the angle and finally lowering the arm 67, 68.

Figure 7A:
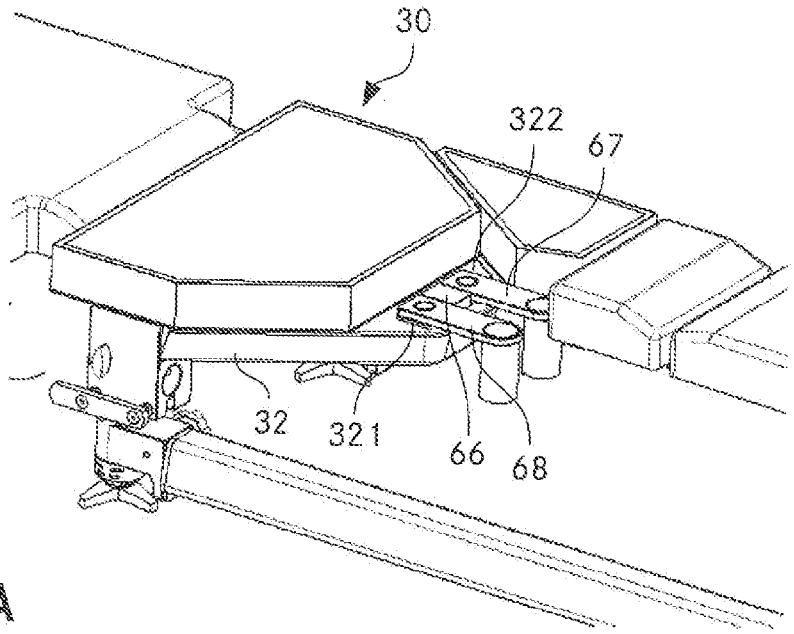
FIG. 7A, B oblique views of the holding mechanism attached to the operating table in different operating positions.
Figure 7B:
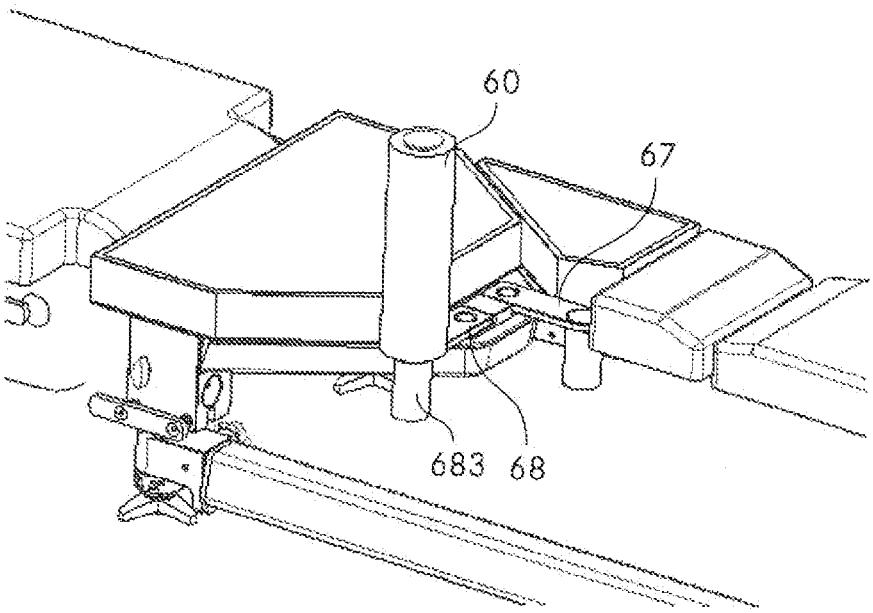

In FIG. 7A, the basic position of the two arms 67, 68 is shown, both arms extending perpendicular to the base part 66, i.e. parallel to the longitudinal extension of the operating table. If a perineal post 60 is needed, the arm 68 on the respective side is positioned in the collinear position (i.e. perpendicular to the longitudinal direction of the operating table) and the perineal post 60 is attached to the respective post support 683 (cf. FIG. 7B).

Figure 8A:
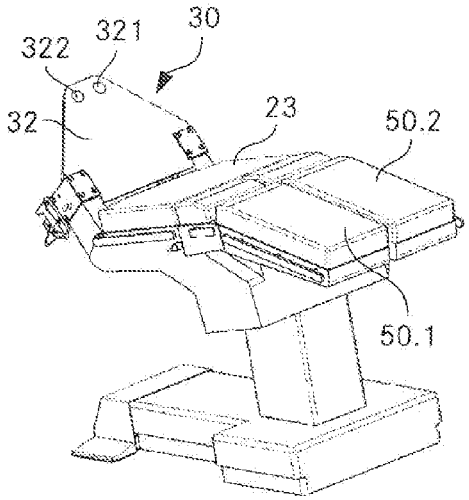
FIG. 8A an oblique view of the operating table in an operating position for shoulder surgery.
Figure 8B:
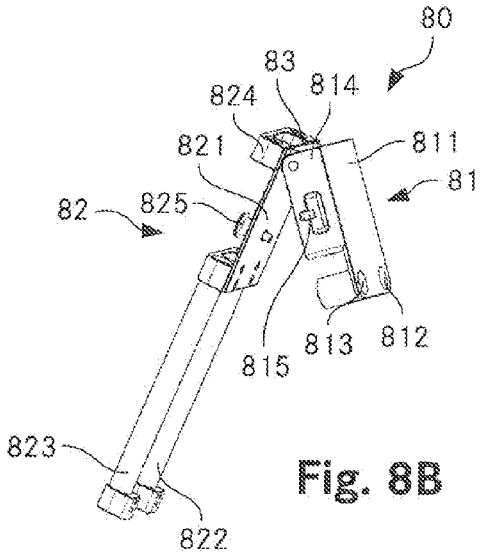
FIG. 8B an oblique view of a head support adapter for the operating table.
Figure 8C:
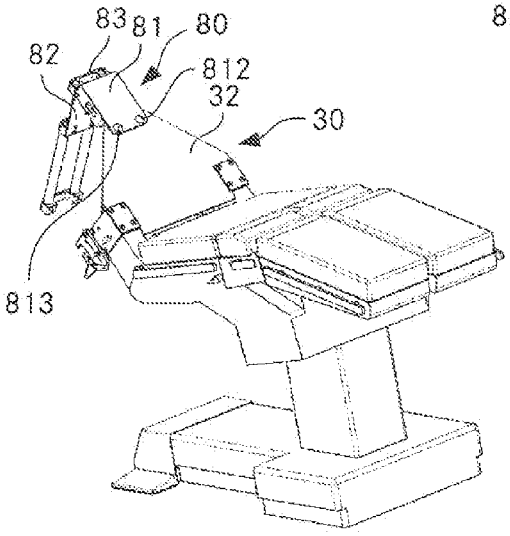
FIG. 8C, D oblique views of the operating table with the head support adapter attached.
Figure 8D:
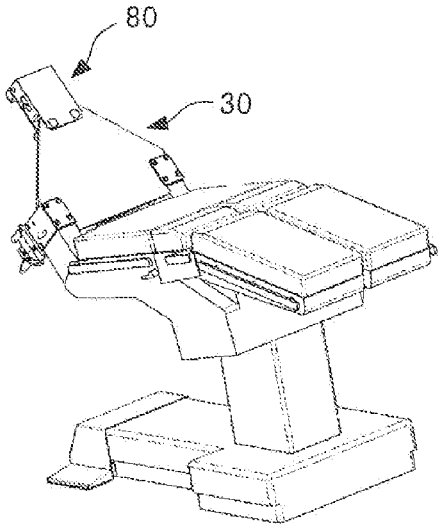
FIG. 8E, F oblique views of the operating table with the head support attached.
Figure 8E:
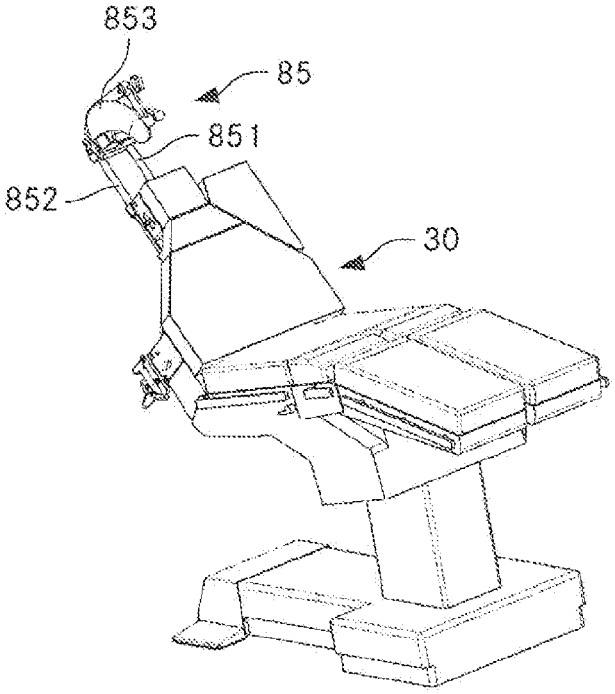

The FIG. 8A is an oblique view of the operating table in an operating position for shoulder surgery. The FIG. 8B is an oblique view of a head support adapter for the operating table. The FIGS. 8C, D show oblique views of the operating table with the head support adapter attached. The FIGS. 8E, F show oblique views of the operating table with the head support attached.

For shoulder surgery, the seat element 30 constitutes a back support for the patient and the leg plates 50.1, 50.2 together with the respective interfacing elements are attached next to the support plate 23. This means that the operating table is used in an inverted position with respect to the patient. In order to provide a head support, a head support adapter 80 (cf. FIG. 8B) is attached to the seat element 30.

Figure 8F:
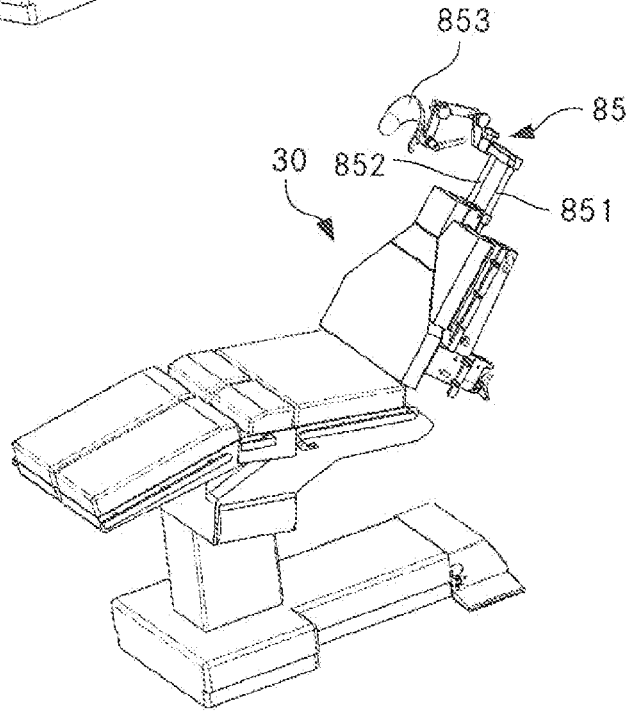

The head support adapter 80 comprises a base part 81 and a guide part 82, the two parts being connected by a hinge 83. The base part 81 comprises a base plate 811, the rear side of which being provided with two connection pegs 812, 813. The base part 81 further features a housing 814 which is as well attached to the rear of the base plate 811. Laterally, the housing 814 is provided with connection elements 815 for connecting additional elements such as an additional support cushion (cf. FIG. 8E, 8F). On the rear side, the housing is provided with a coupler.

The guide part 82 comprises a base plate 821, the front side of it being provided with two guide tubes 822, 823 attached in a region opposite the hinge 83 and a guide bracket 824 with collinear guides attached in a region neighbouring the hinge 83. A locking peg 825 is guided in the base plate 821. It is able to cooperate with the coupler of the base part 81 in order to lock the guide part 82 to the base part 81 in a position where the rear of the housing 814 of the base part 81 and the rear of the base plate 821 of the guide part 82 are parallel and contact each other (see below).

For mounting the head support, first the head support adapter 80 is attached to the seat element 30. For that purpose, the connection pegs 812, 813 are introduced into the two holes 321, 322 in the support plate 32 of the seat element 30 (cf. FIG. 8C). Next, the base part 81 and the guide part 82 are folded about the hinge 83 until the two parts may be locked together (cf. FIG. 8D).

In a next step, the head support 85 is attached to the head support adapter 80. For that purpose, the head support 85 comprises two guide rods 851, 852 cooperating with the guide tubes 822, 823 and the collinear guides of the guide bracket 824 of the head support adapter 80. The actual head support 853 is attached to the top end of the guide rods 851, 852 in a manner known as such. Cushions are attached to the seat element 30, covering the support plate 32 of the seat element 30 as well as the head support adapter 80. As mentioned before, additional cushions may be laterally attached to the head support adapter 80 (cf. FIGS. 8E, 8F).

Figure 9A:
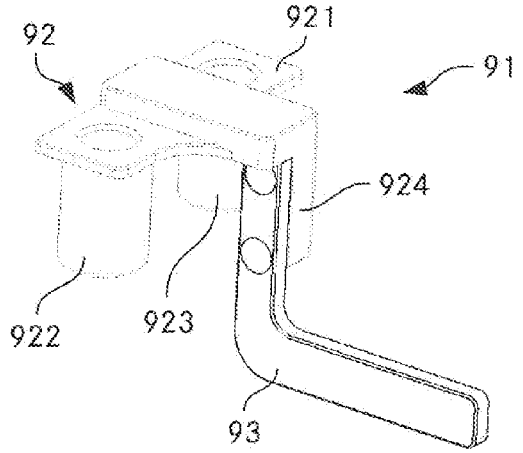
FIG. 9A an oblique view of a holding mechanism for a knee support bar.

The FIG. 9A is an oblique view of a holding mechanism for a knee support bar. The FIGS. 9B, C are oblique views of the operating table with the knee support bar attached. The holding mechanism comprises a knee support adapter 91 featuring a base part 92 and a fixation rail 93. The base part 92 is constituted of a base plate 921 which is essentially T-shaped and which features on its rear side two connection pegs 922, 923. Attached on the front side of the base plate 921 is an L-shaped fastening angle element 924, a first leg thereof being affixed to the base plate 921 and a second leg thereof presenting an attachment surface for attaching the fixation rail 93. The fixation rail 93 is L-shaped as well, the first leg being attached to the attachment surface of the fastening angle element 924, the second leg being free and extending in a direction that is perpendicular to the axes of the two connection pegs 922, 923 as well as perpendicular to the longitudinal extension of the base part 92.

For mounting a knee support bar 90, first the knee support adapter 91 is attached to the seat element 30. For that purpose, the connection pegs 922, 923 are introduced into the two holes 321, 322 in the support plate 32 of the seat element 30 (cf. FIG. 9B). Next, a support rod 95 for the knee support bar 91 is attached to the fixation rail 93 of the knee support adapter 91 in a manner known as such, using a corresponding clamp 94. Finally, the knee support bar 90 may be attached to a horizontal leg of the support rod 95.

Figure 9B:
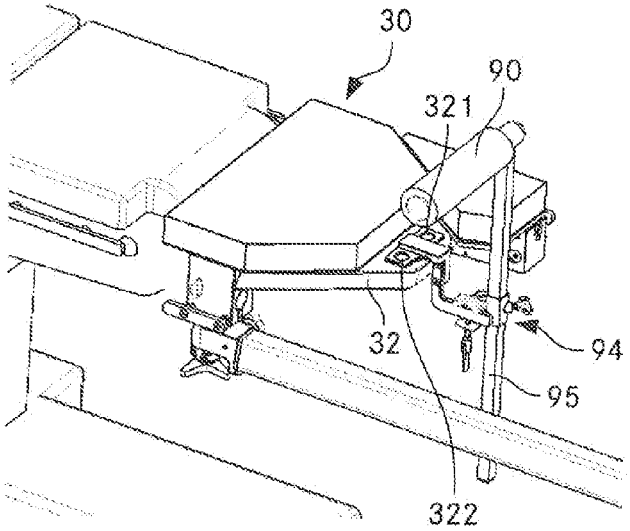
FIG. 9B, C oblique views of the operating table with the knee support bar attached.
Figure 9C:
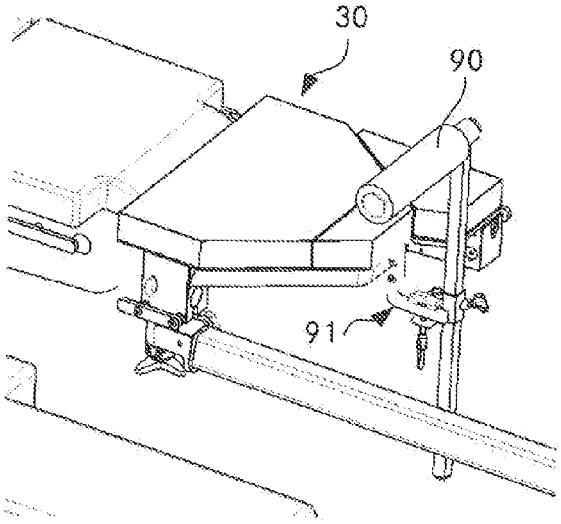

The same clamp 94 may be used to attach the support rod 95 for the knee support bar 91 to a side rail. Depending on the patient, the planned surgery as well as the individual preferences of the surgeon, the operating table according to the embodiment allows for attaching the knee support bar centrally, as shown in FIGS. 9A-C, as well as laterally.

The invention is not limited to the shown embodiment. In particular the geometry of the different elements and the means for connecting the elements to each other may be chosen differently.

In summary, it is to be noted that the invention provides a modular operating table that has favorable characteristics as an orthopedic operating table as well as a universal operating table.

The invention claimed is:

1. A modular operating table comprising a) a support and b) a base part attached to the support, the base part providing a first region of a support surface for a patient's body during surgery, the base part comprising side bars extending parallel to a longitudinal axis of the support surface in lateral edge regions of the support surface, c) a seat element attached to the base part, the seat element providing a second region of the support surface, a width of the second region decreasing in a distal direction, symmetric to a central longitudinal axis of the support surface, the seat element having at least two first connection elements for the distal attachment of functional components, the at least two first connection elements being arranged along main axes of the side bars, d) a first functional component comprising a generally triangular plate providing a third region of the support surface, the first functional component being attachable to one of the at least two first connection elements of the seat element, the attachment of two of said first functional components complementing a generally rectangular support area in a distal region of the seat element, characterized in that e) the first functional component has a second connection element for the distal attachment of functional components, the second connection element being arranged along the main axis of the corresponding side bar when the first functional component is attached to the seat element.

2. The modular operating table as recited in claim 1, wherein the seat element is x-ray transparent.

3. The modular operating table as recited in claim 2, wherein a plate providing the second region of the support surface is made from carbon fiber reinforced polymers.

4. The modular operating table as recited in claim 1, wherein the seat element further has at least one third connection element comprising an articulation mechanism for the attachment of functional components.

5. The modular operating table as recited in claim 4, wherein the at least two first connection elements of the seat element comprise a retainer for receiving a connection peg of a functional component attached to the seat element, and a locking element for selectively locking the connection peg received in the retainer, wherein the retainer is provided in a housing, the articulation mechanism of the third connection element being attached to the housing of the retainer.

6. The modular operating table as recited in claim 1, wherein the at least two first connection elements of the seat element comprise a retainer for receiving a connection peg of a functional component attached to the seat element, and a locking element for selectively locking the connection peg received in the retainer.

7. The modular operating table as recited in claim 6, wherein the locking element comprises an undercut projection and in that an attachment mechanism of the first functional component cooperating with one of the at least two first connection elements comprises a spring-loaded latch cooperating with the undercut projection, the first functional component further comprising an operating element for releasing the latch.

8. The modular operating table as recited in claim 1, wherein the at least two first connection elements of the seat element provide an additional point of support for the functional components in order to obtain a torque proof connection.

9. The modular operating table as recited in claim 1, wherein the seat element comprises at least two holes for connecting extension elements, the at least two holes being arranged along a line perpendicular to the longitudinal axis of the support surface.

10. The modular operating table as recited in claim 9, wherein the at least two holes penetrate a base plate of the seat element and in that the seat element comprises a cover for covering the at least two holes, the cover constituting a section of the third region of the support surface when attached to the base plate of the seat element.

11. The modular operating table as recited in claim 9, further comprising an offset element comprising at least two pins for cooperating with the at least two holes of the seat element and at least one connection element for a perineal post.

12. The modular operating table as recited in claim 9, further comprising a perineal post holder comprising a base that is connectible with the at least two holes and at least one adjustable arm providing a mount for a perineal post, the adjustable arm being attachable to the base in at least two angular positions.

13. The modular operating table as recited in claim 9, further comprising a head support adapter comprising a first portion for attaching the head support adapter to the seat element using the at least two holes and a second portion for attaching a head support.

14. The modular operating table as recited in claim 13, wherein the first portion of the head support adapter is connected to the second portion of the head support adapter by means of a hinge and in that the first portion and the second portion sandwich a base plate of the seat element in a mounted state of the head support adapter.

15. The modular operating table as recited in claim 9, further comprising a knee support adapter comprising a first portion for attaching the knee support adapter to the seat element using the at least two holes and a second portion for attaching a knee support in a region of a central vertical plane of the modular operating table.

16. The modular operating table as recited in claim 9, wherein the extension element is a perineal post.

17. A modular operating table comprising a) a support and b) a base part attached to the support, the base part providing a first region of a support surface for a patient's body during surgery, the base part comprising side bars extending parallel to a longitudinal axis of the support surface in lateral edge regions of the support surface, the side bars being load bearing elements carrying the support, c) a seat element attached to the base part, the seat element providing a second region of the support surface, a width of the second region decreasing in a distal direction, symmetric to a central longitudinal axis of the support surface, the seat element having at least two first connection elements for the distal attachment of functional components, the at least two first connection elements being arranged along main axes of the side bars, d) a first functional component comprising a generally triangular plate providing a third region of the support surface, the first functional component being attachable to one of the at least two first connection elements of the seat element, the attachment of two of said first functional components complementing a generally rectangular support area in a distal region of the seat element, characterized in that e) the first functional component has a second connection element for the distal attachment of functional components, the second connection element being arranged along the main axis of the corresponding side bar when the first functional component is attached to the seat element.

* * * * *